US006356021B2

(12) United States Patent
Irikura et al.

(10) Patent No.: US 6,356,021 B2
(45) Date of Patent: Mar. 12, 2002

(54) BUILT-IN RESISTOR FOR CATHODE-RAY TUBE

(75) Inventors: Masao Irikura, Kamakura; Aiko Takemoto, Yokohama; Suejiro Iwata, Hyogo, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/783,972

(22) Filed: Feb. 16, 2001

Related U.S. Application Data

(63) Continuation of application No. PCT/JP00/03827, filed on Jun. 13, 2000.

(30) Foreign Application Priority Data

Jun. 18, 1999 (JP) ..... 11-171894

(51) Int. Cl.[7] ..... H01J 23/16

(52) U.S. Cl. ..... 315/3; 315/5.37; 338/308; 338/314; 313/449

(58) Field of Search ..... 315/1, 3, 5.37; 313/346 R, 412, 414, 447, 449; 338/308, 309, 314; 427/101–103, 126.2, 126.3, 126.6

(56) References Cited

U.S. PATENT DOCUMENTS 4,349,767 A * 9/1982 Muramoto et al. ..... 313/449
4,672,269 A * 6/1987 Kamohara ..... 315/3
4,760,370 A 7/1988 Nikaido et al. ..... 338/308
6,034,469 A * 3/2000 Uda et al. ..... 313/346 R

FOREIGN PATENT DOCUMENTS

JP 6-251901 9/1994
JP 7-134952 5/1995

OTHER PUBLICATIONS

Rikagaku Jiten, the 4th edition (Japan) Kabushiki Kaisha Iwanami Shoten (Dec. 10, 1987), pp. 665–666.

* cited by examiner

*Primary Examiner*—Haissa Philogene
(74) *Attorney, Agent, or Firm*—Oblon, Spivak, McClelland, Maier & Neustadt, P.C.

(57) ABSTRACT

A built-in resistor for cathode-ray tube which comprises an insulating substrate, a resistance layer formed on one main surface of the insulating substrate, a plurality of terminal electrodes mounted on the resistance layer, and a plurality of terminals connected respectively with the terminal electrodes, wherein the plurality of terminals are individually constituted by a base body made of a non-magnetic alloy, and by a surface layer which is formed on the surface of the base body and made of an oxide of the non-magnetic alloy, the plurality of terminals have a relative permeability of not more than 1.005, and the surface layer of each of the terminals is partially provided with an insulating covering layer. The nonmagnetic alloy is a Ni—Cr-based alloy, and the surface layer is formed through an oxidation treatment under a condition where the formation of NiO can be suppressed.

18 Claims, 3 Drawing Sheets

BUILT-IN RESISTOR FOR CATHODE-RAY TUBE

CROSS-REFERENCE TO RELATED APPLICATIONS

This is a Continuation Application of PCT Application No. PCT/JP00/03827, filed Jun. 13, 2000, which was not published under PCT Article 21(2) in English.

This application is based upon and claims the benefit of priority from the prior Japanese Patent Application No. 11-171894, filed Jun. 18, 1999, the entire contents of which are incorporated herein by reference.

BACKGROUND OF THE INVENTION

This invention relates to a built-in resistor for cathode-ray tube, which is adapted to be employed for a cathode-ray tube such as a color cathode-ray tube, and also related to a cathode-ray tube housing this built-in resistor.

The loading of voltage to a convergence electrode or focus electrode to be employed in an electronic tube such as a color cathode-ray tube for color television receiver has been conducted by dividing an anode voltage by means of a voltage dividing resistor.

FIGS. 1 to 3 illustrate a conventional voltage dividing resistor, wherein FIG. 1 is a plan view thereof, FIG. 2 is a cross-sectional view taken along the line II—II of FIG. 1, and FIG. 3 is an enlarged partial view of FIG. 1.

Referring to FIGS. 1 to 3, on one main surface 21*a* of an insulating substrate 21 made mainly of aluminum oxide, there are arranged five terminal electrode layers 22A to 22E which are formed by the steps of printing an electrode material comprising metal oxides including ruthenium oxide and lead borosilicate glass, drying and baking the printed layer. A predetermined pattern of a resistance layer 23 is formed so as to interconnect these terminal electrode layers 22A to 22E with each other.

This resistance layer 23 is formed by a process wherein a resistance material comprising metal oxides including ruthenium oxide and lead borosilicate glass is printed on the main surface 21*a* in such a pattern that enables to obtain a predetermined resistance value, and the resultant layer is subsequently dried and baked. This resistance layer 23 is subsequently covered with an insulating covering layer 24*a*.

In the regions of the insulating substrate 21 where these terminal electrode layers 22A to 22E are located, there are formed through-holes 25 penetrating from the main surface 21*a* of the substrate to the other main surface 21*b* of the substrate. These terminal electrode layers 22A to 22E are electrically connected with terminals 26A to 26E, respectively. One end of each of these terminals 26A to 26E is respectively caulked to the corresponding through-hole 25.

Namely, as shown in FIG. 3, one end of each of terminals 26A to 26E is constituted by a cylindrical portion 26*a* and a flange portion 26*b*, wherein the cylindrical portion 26*a* is inserted into the through-hole 25 and the distal end portion of the cylindrical portion 26*a* is caulked and fixed to the other main surface 21*b* of the substrate.

By the way, these terminals 26A to 26E are generally formed of a non-magnetic alloy such as non-magnetic stainless steel (Fe—Ni—Cr-based alloy) so as not to badly affect the magnetic field to be generated by a deflection yoke (not shown). By the way, this expression of "non-magnetic" means, as far as this technical field is concerned, that the relative permeability of material is not more than 1.01, more preferably not more than 1.005.

The caulked portion 26*c* of the terminal is usually covered with an insulating covering layer 24*b* in order to suppress any abnormal discharge that might be derived from a potential difference between this caulked portion 26*c* and the inner wall of the neck portion of cathode-ray tube (not shown).

This insulating covering layer 24*b* is demanded to have features that it is excellent in heat-resistance so as to withstand against the heating process in the manufacturing process of cathode-ray tube, it is minimal in gas releasability so as not to badly affect the vacuum inside the tube, and it is minimal also in difference in thermal expansion coefficient relative to the insulating substrate. In view of these demands, this insulating covering layer 24*b* is generally formed of a lead borosilicate glass.

However, since the thermal expansion coefficient of these terminals 26A to 26E made of a non-magnetic alloy is approximately three times as high as that of the insulating substrate or insulating covering layers, cracks are caused to generate in a region of the insulating covering layer 24*b* which is located in the vicinity of the caulked portion 26*c* of each of the terminals 26A to 26E, thereby raising a problem that a piece of the insulating covering layer is peeled away and falls from this caulked portion.

If this caulked portion is exposed in this manner, an abnormal discharge may be more likely to be generated, and furthermore, if this peeled piece of the insulating covering layer is adhered to the electron gun or to the inner wall of the neck portion, the withstand voltage property of these members would be deteriorated. Additionally, if this peeled piece of the insulating covering layer is adhered to the apertures of the shadow mask, the clogging thereof would be resulted, thereby giving rise to the deterioration of the yield of cathode-ray tube.

Whereas, if these terminals are formed by making use of an alloy such as covar (Fe—Ni—Co alloy) or a 42 alloy (42%Fe—Ni alloy), the aforementioned problem of the peeling of the insulating covering layer may be suppressed, since the thermal expansion coefficient of the layer made from these alloys can be made almost identical with the thermal expansion coefficient of the insulating covering layer. However, since these alloys are magnetic alloys exhibiting a high permeability, the magnetic field generated from the deflection yoke would be distorted, thereby raising a problem of generating a defective picture image.

This invention has been made in view of the aforementioned technical problems, and hence, an object of this invention is to provide a resistor for cathode-ray tube which is capable of inhibiting the generation of abnormal discharge at the terminal portion and also capable of inhibiting the peel-off of the insulating covering layer, thereby enabling the cathode-ray tube to display a picture image of high quality.

Another object of this invention is to provide a cathode-ray tube which is provided therein with a resistor which is capable of inhibiting the generation of abnormal discharge at the terminal portion and also capable of inhibiting the peel-off of the insulating covering layer, thereby enabling the cathode-ray tube to display a picture image of excellent quality.

BRIEF SUMMARY OF THE INVENTION

According to this invention, there is provided a built-in resistor for cathode-ray tube which comprises an insulating substrate, a resistance layer formed on one main surface of the insulating substrate, a plurality of terminal electrodes mounted on the resistance layer, and a plurality of terminals connected respectively with the terminal electrodes; wherein the plurality of terminals are individually constituted by a base body comprising a non-magnetic alloy, and by a surface layer which is formed on the surface of the base body and comprising an oxide of the non-magnetic alloy, the plurality of terminals have a relative permeability of not more than 1.005, and the surface layer of each of the plurality of terminals is partially provided with an insulating covering layer.

According to this invention, there is further provided a cathode-ray tube comprising an envelope constituted by a panel portion having a fluorescent screen formed on an inner surface thereof and by a funnel portion having a neck portion; and an electron gun disposed inside the neck portion and comprising a cathode assembly, a plurality of grid electrodes, and a resistor for loading a divided partial voltage on the plurality of grid electrodes; which is featured in that the resistor comprises an insulating substrate, a resistance layer formed on one main surface of the insulating substrate, a plurality of terminal electrodes mounted on the resistance layer, and a plurality of terminals connected respectively with the terminal electrodes; the plurality of terminals being individually constituted by a base body comprising a non-magnetic alloy, and by a surface layer formed on the surface of the base body and comprising an oxide of the non-magnetic alloy; wherein the plurality of terminals have a relative permeability of not more than 1.005, and the surface layer of each of the plurality of terminals is partially provided with an insulating covering layer.

As explained above, this invention is featured in that the terminals of the resistor is constituted by a non-magnetic alloy, that the surface layer of the terminals is constituted by an oxide of the non-magnetic alloy, and that the relative permeability of the terminals as a whole is controlled to not more than 1.005.

Preferably, the surface layer of the terminals is formed of an oxide layer that can be obtained through the oxidation of the surface of the base body made of a non-magnetic alloy. As a result, it becomes possible to obtain a surface layer exhibiting an excellent adhesivity.

The non-magnetic alloy constituting the base body of the terminals should preferably be Ni—Cr-based alloy. Therefore, the surface layer should preferably be formed of a material comprising, as a main component, $Cr_2O_3$ and $NiCr_2O_4$ that can be obtained through an oxidation of the surface of the base body made of Ni—Cr-based alloy.

The aforementioned surface layer comprising, as a main component, $Cr_2O_3$ and $NiCr_2O_4$ can be formed through a selective oxidation of the surface of the base body made of Ni—Cr-based alloy, i.e. through an oxidation treatment under a condition where the formation of nickel oxide or NiO can be suppressed. The condition for such a selective oxidation may be such that the surface is at first heat-treated at a temperature of 980 to 1100° C. in a reducing atmosphere and then, heat-treated at a temperature of 950 to 1050° C. in an oxidizing atmosphere.

When the heat treatment in an oxidizing atmosphere is performed at a temperature of less than 950° C., the processing becomes too slow to apply it to a practical use. On the hand, when the temperature of this heat treatment is higher than 1050° C., it becomes difficult to effectively perform the selective oxidation.

The reducing atmosphere may be an atmosphere containing hydrogen for instance, while the oxidizing atmosphere may be an atmosphere containing water vapor.

The surface layer should preferably be formed of a material containing $Cr_2O_3$ and $NiCr_2O_4$ at a ratio of 60% by weight or more, more preferably 90% by weight or more. The thickness of the surface layer should preferably be in the range of 0.5 to 2 $\mu$m, most preferably about 1 $\mu$m.

The surface layer obtained through the aforementioned selective oxidation is suitable for enhancing the adhesive strength thereof with an insulating covering layer to be deposited thereon. Therefore, even if cracks are generated in the insulating covering layer due to a difference in thermal expansion coefficient between the terminals and the insulating covering layer, it is possible to prohibit the insulating covering layer from being peeled away. Therefore, the terminals can be prevented from being exposed through this insulating covering layer, thereby making it possible to suppress the generation of abnormal discharge and also to suppress the deterioration of yield that might be caused by the peeling-off of the insulating covering layer.

Further, even if the surface of the terminals is constituted by an oxide surface layer, the relative permeability of the terminals as whole can be controlled to not more than 1.005, i.e. a value which makes it possible to prevent the generation of distortion in a magnetic field generated by the deflection yoke. Therefore, when this resistor is incorporated in a cathode-ray tube, a picture image excellent in quality can be obtained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

One embodiment of this invention will be explained in details with reference to the drawings as follows.

Figure 1:
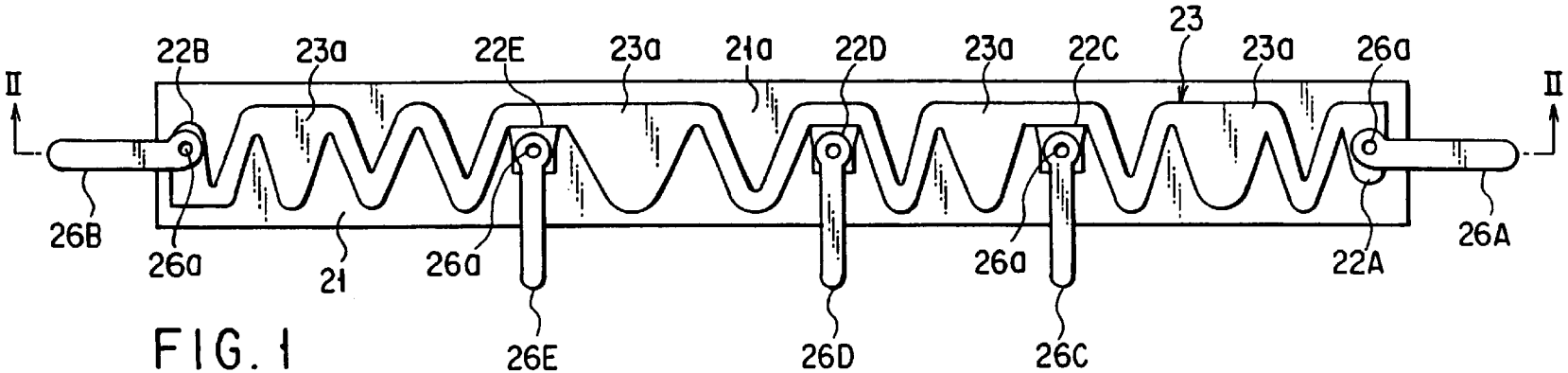
FIG. 1 PRIOR ART
FIG. 1 is a plan view showing a resistor for cathode-ray tube according to the prior art.
Figure 2:
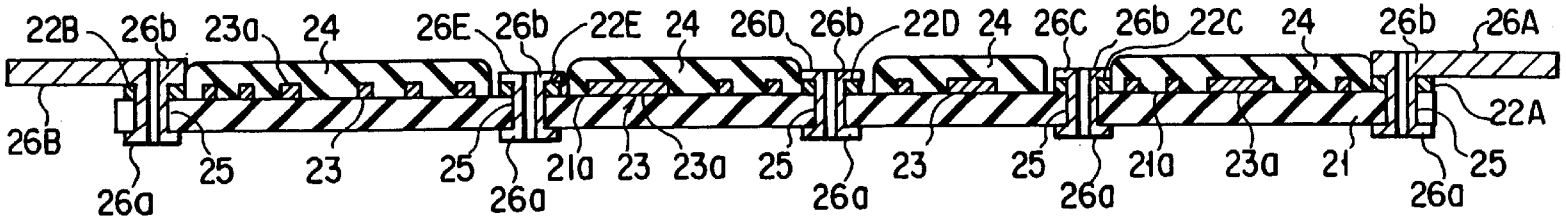
FIG. 2 PRIOR ART
FIG. 2 is a cross-sectional view of the resistor for cathode-ray tube shown in FIG. 1.
Figure 3:
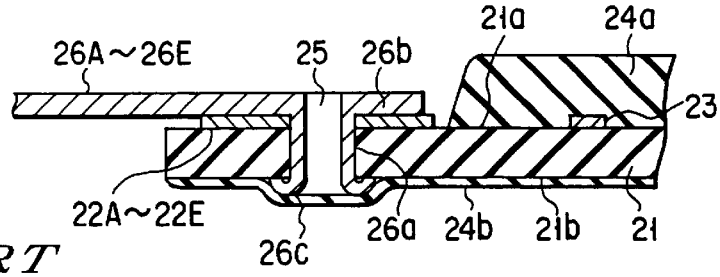
FIG. 3 PRIOR ART
FIG. 3 is a cross-sectional view illustrating a main portion of the resistor for cathode-ray tube shown in FIG. 1.
Figure 4:
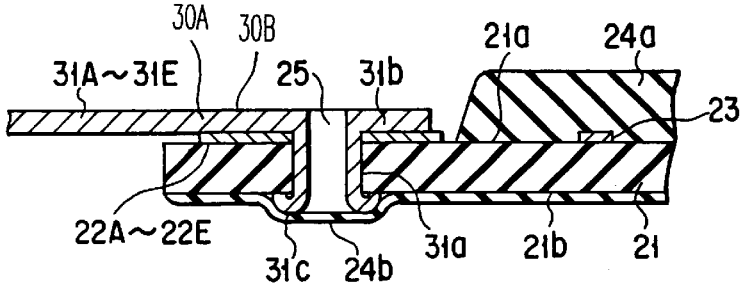
FIG. 4 is a cross-sectional view illustrating a main portion of the resistor for cathode-ray tube according to one embodiment of this invention.

FIG. 4 is a cross-sectional view illustrating the resistor for cathode-ray tube according to this invention. By the way, the same parts or members as those shown in the conventional resistor of FIGS. 1 to 3 will be identified by the same numerals in this FIG. 4.

Referring to FIG. 4, on one main surface 21*a* of an insulating substrate 21 made mainly of aluminum oxide, there are arranged terminal electrode layers 22A to 22E which are formed by the steps of printing an electrode material comprising metal oxides including ruthenium oxide and lead borosilicate glass, drying and baking the printed layer. Further, in the same manner as in the case of the conventional resistor, a resistance layer 23 is formed so as to interconnect these terminal electrode layers 22A to 22E with each other.

This resistance layer 23 is formed by a process wherein a resistance material comprising metal oxides including ruthenium oxide and lead borosilicate glass is printed on the main surface 21*a* in such a pattern that enables to obtain a predetermined resistance value, and the resultant layer is subsequently dried and baked. This resistance layer 23 is subsequently covered with an insulating covering layer 24*a* made of lead borosilicate glass.

In the regions of the insulating substrate 21 where these terminal electrode layers 22A to 22E are located, there are formed through-holes 25 penetrating from the main surface 21*a* of the substrate to the other main surface 21*b* of the substrate. These terminal electrode layers 22A to 22E are electrically connected with terminals 31A to 31E, respectively. Each of these terminals 31A to 31E is respectively attached to the corresponding through-hole 25 and caulked to the insulating substrate 21.

Namely, as shown in FIG. 4, each of terminals 31A to 31E is constituted by a cylindrical portion 31*a* and a flange portion 31*b*, wherein the cylindrical portion 31*a* is inserted into the through-hole 25 and the distal end portion thereof is caulked and fixed to the other main surface of the substrate.

These terminals 31A to 31E can be manufactured as follows. Namely, a 20%Cr—Ni-based alloy thin plate that has been annealed is molded into a predetermined shape by means of press working, which is followed by degreasing and washing. Thereafter, the resultant thin plate is heat-treated for eight minutes in a reducing atmosphere consisting of pure hydrogen gas at a temperature of 1030° C. Thereafter, this heat-treated plate or base body 30*a* is placed in an atmosphere containing hydrogen gas and 20° C. in dew point, and then, subjected to a heat treatment for 20 minutes at an atmospheric temperature of 1000° C. to form an oxide surface layer 30*b*, thus obtaining the terminal member illustrated in FIG. 4.

It has been found, as a result of the analysis performed by means of x-ray diffraction method, that both top and back surfaces of the terminal member thus manufactured were denatured into an oxide layer consisting mainly of $Cr_2O_3$ and $NiCr_2O_4$ and having a depth of about 1 $\mu$m. In this case, the total content of $Cr_2O_3$ and $NiCr_2O_4$ in the oxide layer was about 90% by weight ($Cr_2O_3$: about 60%, $NiCr_2O_4$: about 30%).

It is known through experiments that if a large quantity of NiO is deposited during the oxidizing step, the strength of oxide film would be deteriorated, thereby giving rise to the peel-off of the film. Therefore, with a view to prevent this phenomenon, the atmosphere and temperature in the step of oxidizing treatment are adjusted as explained above, thereby enabling the oxide film to selectively deposit so as to have a composition consisting mainly of $Cr_2O_3$ ($Cr_2O_3$ and $NiCr_2O_4$). Namely, the selective oxidation was carried out so as to allow Cr to be selectively oxidized rather than Ni.

The content of NiO in the oxide film should preferably be not more than 10%, more preferably not more than 5%. By the way, as a result of the aforementioned analysis, NiO could not be detected under the above conditions set forth in this embodiment.

Further, when the relative permeability of the terminal member that has been heat-treated as mentioned above was measured based on the JIS No. C2563, it was found 1.0007. By the way, since the relative permeability of the terminal member consisted of only a single layer of alloy was also 1.0007, it will be concluded that the relative permeability of the terminal member can be hardly affected by the formation of the oxide layer. This phenomenon may be attributed to the facts that the $Cr_2O_3$ to be deposited through the oxidizing treatment is an anti-ferromagnetic material (permeability: 1), while the $NiCr_2O_4$ to be deposited likewise exhibits ferromagnetism at low temperature but exhibits paramagnetism at the normal temperature (permeability: 1.00005–1.001), and that the oxide layer is mainly consisted of these oxides.

By the way, for the purpose of comparison, the non-magnetic stainless steel that has been conventionally employed was heat-treated to manufacture a terminal member. As a result, the relative permeability thereof was found more than 1.01. This may be attributed to the fact that ferromagnetic $Fe_3O_4$ was caused to deposit on the surface of the terminal member by the oxidizing treatment.

When the terminals manufactured according to the method of this invention were mounted on a resistor as shown in FIG. 4 and then, subjected to a forced vibration test by way of ultrasonic vibration, the falling of the insulating covering layer 24*b* was not recognized at all.

Figure 5:
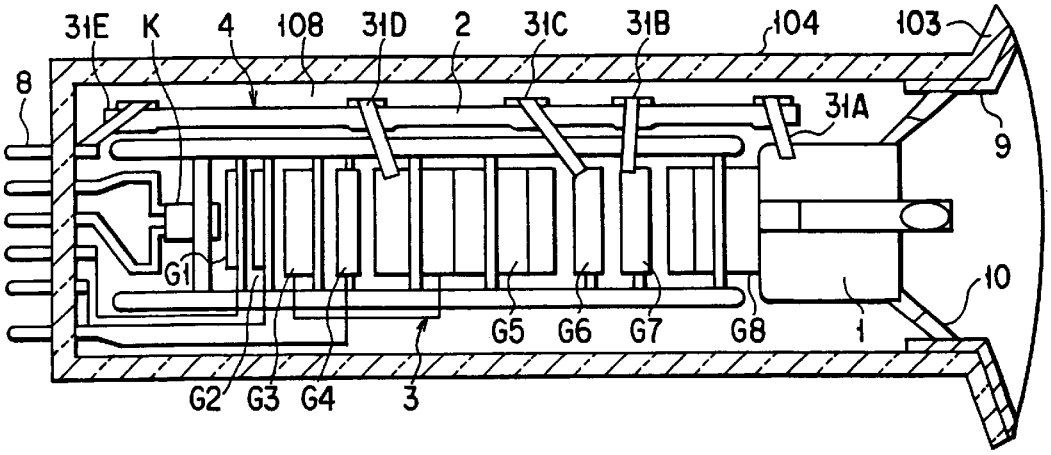
FIG. 5 is a cross-sectional view illustrating the structure of the electron gun for cathode-ray tube according to one embodiment of this invention.
Figure 6:
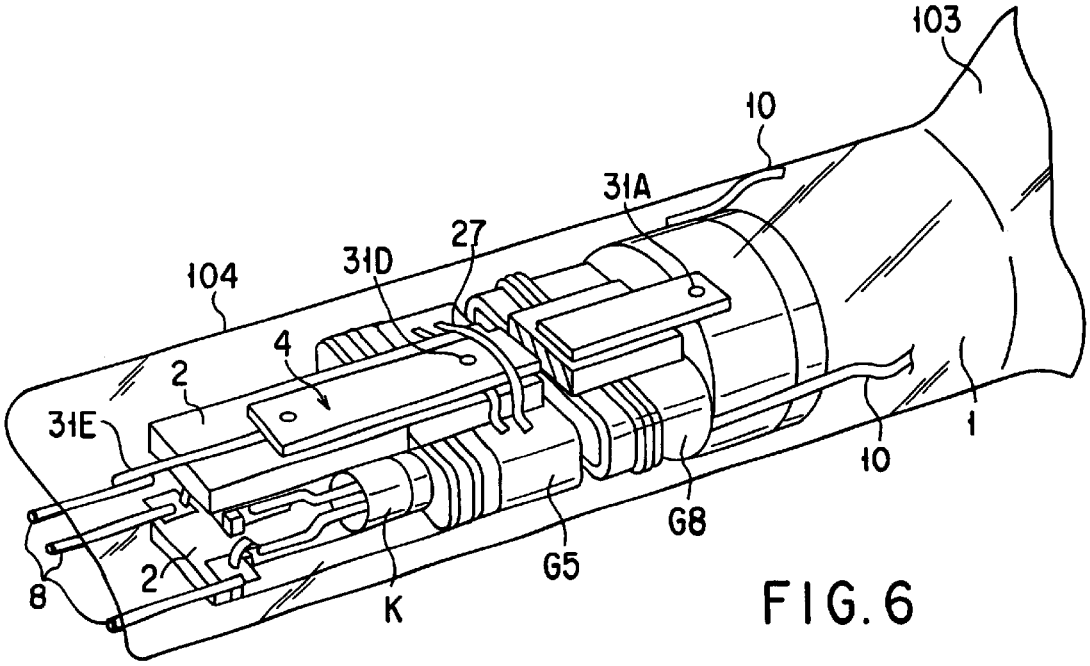
FIG. 6 is a cross-sectional view illustrating the structure of the electron gun for cathode-ray tube according to one embodiment of this invention.

FIGS. 5 and 6 show an electron gun 108 into which the resistor shown in FIG. 4 is incorporated. This electron gun 108 in which a first grid electrode G1, a second grid electrode G2, a third grid electrode G3, a fourth grid electrode G4, a fifth grid electrode G5, a sixth grid electrode G6, a seventh grid electrode G7, a eighth grid electrode G8 are successively and coaxially arranged, all in common to, onto three cathode structures K. A convergence electrode 1 is disposed behind the eighth grid electrode G8.

All of these grid electrodes G1, G2, G3, G4, G5, G6, G7 and G8 are mechanically held by bead glass 2 while retaining a predetermined positional relationship among them. Further, the third grid electrode G3 and the fifth grid electrode G5 are electrically connected with each other via a lead wire 3. On the other hand, the convergence electrode 1 is electrically connected by means of welding with the eighth grid electrode G8.

The resistor shown in FIG. 4 is mounted on the top surface of the electron gun 108. The terminals 31B, 31C and 31D are electrically connected with the seventh grid electrode G7, the sixth grid electrode G6 and the fifth grid electrode G5, respectively. Further, the terminal 31A is connected with the convergence electrode 1, and the terminal 31E is connected with the ground electrode pin 8.

As shown in FIG. 5, a graphite conductive film 9 is adhered onto the inner wall of the funnel 103. This conductive film 9 is extended up to the inner wall of the neck portion of cathode-ray tube (explained hereinafter) to thereby electrically connect it with an anode button (not shown). The convergence electrode 1 is provided with a conductive spring 10 which is designed to be contacted with the graphite conductive film 9, thereby enabling a plate voltage to be fed to the convergence electrode 1, the ground electrode pin 8 and the terminal 31A of the resistor, and at the same time, enabling a partial voltage that will be generated at the terminals 31B to 31D to be fed to the seventh grid electrode G7, the sixth grid electrode G6 and the fifth grid electrode G5, respectively.

Figure 7:
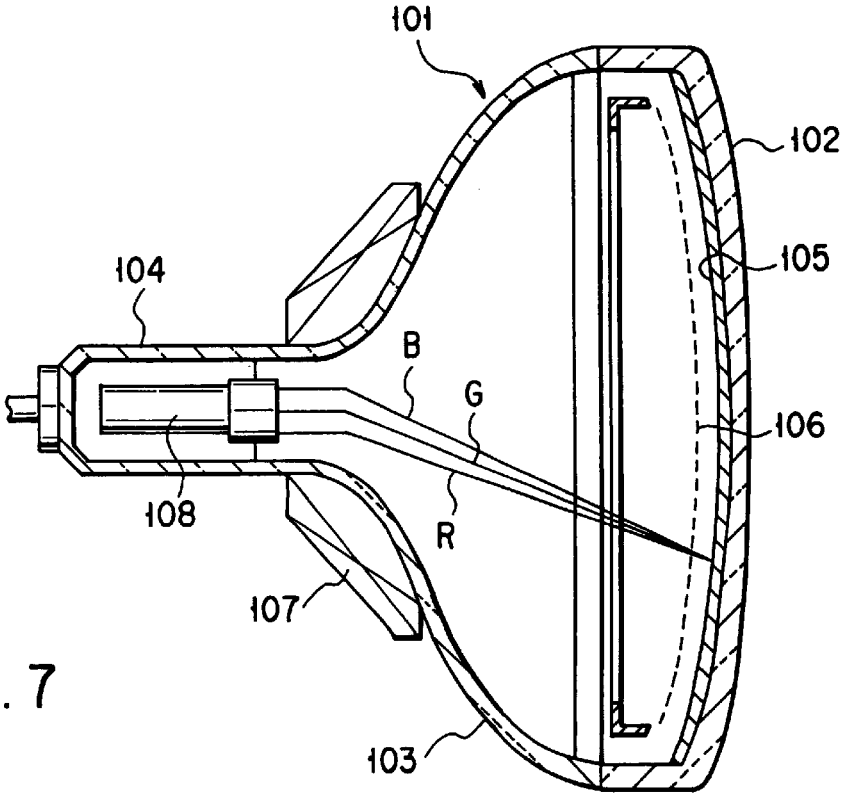
FIG. 7 is a cross-sectional view illustrating the structure of a color cathode-ray tube according to one embodiment of this invention.

FIG. 7 shows a color cathode-ray tube having the aforementioned electron gun incorporated therein. Referring to FIG. 7, the envelope 101 made of glass is constituted by a panel 102 and a funnel 103 having a neck portion 104. On the inner surface of the panel 102 of envelope 101, there is formed a fluorescent screen 105 consisting of a three color fluorescent layer for emitting colors of blue, green and red. Further, a shadow mask 106 having a large number of electron beam transmission apertures is disposed so as to face the fluorescent screen 105.

Further, the electron gun 108 shown in FIGS. 5 and 6 is disposed inside the neck portion 104 of funnel 103 of envelope 101. Three electron beams R, G and B that have been emitted from the electron gun 108 are caused to deflect by a magnetic field to be generated from the deflection yoke 107 mounted on the outside of the funnel 103, thereby enabling these electron beams R, G and B to scan over the fluorescent screen 105 horizontally and vertically, thus displaying a color image.

By the way, according to this embodiment, the terminal member employed in the resistor has a relative permeability of as low as 1.0007. It is already known that as long as the relative permeability of terminal member is not more than 1.005, the distortion of magnetic field can be confined within the acceptable level, and as a matter of fact, when the resistor of this embodiment was incorporated into a color cathode-ray tube, the distortion of image due to the distortion of magnetic field could not be recognized.

Furthermore, it was also confirmed, through the incorporation of the resistor and the electron gun, that neither the generation of defectives such as the clogging of the apertures of the shadow mask by a peeled piece of the insulating covering layer nor the abnormal discharging from the terminal members could be found. This may be attributed to the fact that the thin surface layer 30*b* consisting mainly of $Cr_2O_3$ and $NiCr_2O_4$ which is designed to be formed on the surface of base body 30*a* made of a Cr—Ni-based alloy has a high adhesive strength to both the base body made of a Cr—Ni-based alloy and the insulating covering layer formed on the surface layer. Moreover, since the thin surface layer containing mainly $Cr_2O_3$ and $NiCr_2O_4$ is formed also on the surface of the terminal member which is contacted with the electrode portion, the adhesive strength between the terminal member and the electrode portion is also enabled to be improved.

The surface film of this kind can be obtained preferably by subjecting the surface of the base body to an oxidation treatment in an oxidizing atmosphere, more preferably by subjecting the surface of the base body to an oxidation treatment under a selective oxidizing condition. It may be possible to form this surface layer by depositing it by means of a vapor deposition for instance. However, as compared with the oxide film that has been formed through the aforementioned oxidizing treatment, the oxide film formed through a deposition method is poor in film strength, so that under some circumstances, the upper portion of insulating covering layer may be peeled off.

Further, if the relative permeability of the terminal member as a whole is happened to be increased over 1.005 on account of the oxidation treatment of the alloy base body, the quality of picture image may be badly affected. However, when the surface of the base body made of a Cr—Ni-based alloy is selectively oxidized so as to form an oxide surface layer as described in this embodiment, the relative permeability of the terminal member as a whole can be suppressed to as low as 1.0007, thereby making it possible to obtain a picture image of excellent quality.

As explained above, according to this invention, it is possible to inhibit the generation of abnormal discharge at the terminal portion and also to inhibit the peel-off of the insulating covering layer, thereby making it possible to improve the production yield of the cathode-ray tube. Furthermore, it is also possible, according to this invention, to inhibit the distortion of magnetic field inside the cathode-ray tube to thereby realize a picture image of excellent quality. Therefore, this invention would be very useful in the technical field cathode-ray tube.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A built-in resistor for cathode-ray tube which comprises;

an insulating substrate;

a resistance layer formed on one main surface of the insulating substrate;

a plurality of terminal electrodes mounted on the resistance layer; and a plurality of terminals connected respectively with said terminal electrodes;

wherein said plurality of terminals are individually constituted by a base body comprising a non-magnetic alloy, and by a surface layer which is formed on the surface of the base body and comprising an oxide of said non-magnetic alloy;

said plurality of terminals have a relative permeability of not more than 1.005; and said surface layer of each of the terminals is partially provided with an insulating covering layer.

2. The built-in resistor for cathode-ray tube according to claim 1, wherein said surface layer is formed through an oxidation treatment of the surfaces of said terminals.

3. The built-in resistor for cathode-ray tube according to claim 1, wherein said terminals are respectively provided with a caulking portion which is engaged with and fixed to a through-hole formed in the insulating substrate, and said insulating covering layer is formed on the other main surface of said insulating substrate to cover said caulking portion.

4. The built-in resistor for cathode-ray tube according to claim 1, wherein said non-magnetic alloy is a Ni—Cr-based alloy.

5. The built-in resistor for cathode-ray tube according to claim 4, wherein said surface layer is formed through an oxidation treatment under a condition where the formation of NiO can be suppressed.

6. The built-in resistor for cathode-ray tube according to claim 4, wherein said surface layer comprises, as a main component, $Cr_2O_3$ and $NiCr_2O_4$.

7. The built-in resistor for cathode-ray tube according to claim 5, wherein said surface layer is formed of a material containing $Cr_2O_3$ and $NiCr_2O_4$ at a ratio of 60% by weight or more.

8. The built-in resistor for cathode-ray tube according to claim 1, wherein said surface layer is formed on a surface where said terminals are contacted with said terminal electrodes.

9. The built-in resistor for cathode-ray tube according to claim 1, wherein said surface layer has a thickness ranging from 0.5 to 2 $\mu$m.

10. A cathode-ray tube comprising;

an envelope constituted by a panel portion having a fluorescent screen formed on an inner surface thereof and by a funnel portion having a neck portion; and an electron gun disposed inside the neck portion and comprising a cathode body, a plurality of grid electrodes, and a resistor for loading a divided partial voltage to some of said plurality of grid electrodes;

which is featured in that;

said resistor comprises an insulating substrate, a resistance layer formed on one main surface of the insulating substrate, a plurality of terminal electrodes mounted on the resistance layer, and a plurality of terminals connected respectively with said terminal electrodes;

wherein said plurality of terminals are individually constituted by a base body comprising a non-magnetic alloy, and by a surface layer which is formed on the surface of the base body and comprising an oxide of said non-magnetic alloy; said plurality of terminals have a relative permeability of not more than 1.005; and said surface layer of each of the terminals is partially provided with an insulating covering layer.

11. The cathode-ray tube according to claim 10, wherein said surface layer is formed through an oxidation treatment of the surfaces of said terminals.

12. The cathode-ray tube according to claim 10, wherein said terminals are respectively provided with a caulking portion which is engaged with and fixed to a through-hole formed in the insulating substrate, and said insulating covering layer is formed on the other main surface of said insulating substrate to cover said caulking portion.

13. The cathode-ray tube according to claim 10, wherein said non-magnetic alloy is a Ni—Cr-based alloy.

14. The cathode-ray tube according to claim 13, wherein said surface layer is formed through an oxidation treatment under a condition where the formation of NiO can be suppressed.

15. The cathode-ray tube according to claim 13, wherein said surface layer comprises, as a main component, $Cr_2O_3$ and $NiCr_2O_4$.

16. The cathode-ray tube according to claim 15, wherein said surface layer is formed of a material containing $Cr_2O_3$ and $NiCr_2O_4$ at a ratio of 60% by weight or more.

17. The cathode-ray tube according to claim 10, wherein said surface layer is formed on a surface where said terminals are contacted with said terminal electrodes.

18. The cathode-ray tube according to claim 10, wherein said surface layer has a thickness ranging from 0.5 to 2 $\mu$m.

* * * * *